US006321445B1

(12) United States Patent
Suzuki et al.

(10) Patent No.: US 6,321,445 B1
(45) **Date of Patent: *Nov. 27, 2001**

(54) APPARATUS AND METHOD OF MANUFACTURING AN AUTOMOBILE WIRING HARNESS HAVING A PREDETERMINED WIRING ROUTE

(75) Inventors: Toshiaki Suzuki; Yoshinobu Ohta, both of Nagoya (JP)

(73) Assignees: Harness System Technologies Research, Ltd., Nagoya; Sumitomo Wiring Systems, Ltd., Yokkaichi; Sumitomo Electric Industries Ltd., Osaka, all of (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/009,891

(22) Filed: Jan. 21, 1998

(30) Foreign Application Priority Data

Jan. 28, 1997 (JP) ..... 9-013707

(51) Int. Cl.[7] ..... H01R 43/00

(52) U.S. Cl. ..... 29/857; 29/755; 29/861; 29/863; 29/33 M

(58) Field of Search ..... 29/857, 861, 863, 29/866, 755, 33 M, 868; 140/93 R; 228/5.1

(56) References Cited

U.S. PATENT DOCUMENTS

| | | | | |
|---|---|---|---|---|
| 4,440,053 | * | 4/1984 | Suzuki et al. | 83/282 |
| 4,677,734 | * | 7/1987 | Bloch et al. | 29/564.2 |
| 4,750,265 | | 6/1988 | Watanabe et al. . | |
| 4,803,778 | * | 2/1989 | Cross | 29/857 |
| 4,908,941 | * | 3/1990 | Fukuda et al. | 29/857 |
| 5,052,449 | * | 10/1991 | Fukuda et al. | 149/93 R |
| 5,127,159 | * | 3/1997 | Kudo et al. | 29/863 |
| 5,606,795 | * | 3/1997 | Ohba et al. | 29/863 |
| 5,694,681 | * | 12/1997 | Hatagishi et al. | 29/857 |
| 5,743,010 | * | 4/1998 | Zaguskin et al. | 29/657 |
| 5,783,008 | * | 7/1998 | Belke, Jr. et al. | 156/73.2 |
| 5,829,129 | * | 11/1998 | Ito | 29/857 |
| 5,970,609 | * | 10/1999 | Shioda | 29/861 |

FOREIGN PATENT DOCUMENTS

| | | | | |
|---|---|---|---|---|
| 356 252 | | 2/1990 | (EP) . | |
| 706 242 | | 4/1996 | (EP) . | |
| 1067809 | | 3/1989 | (JP) . | |
| 6-188055 | * | 7/1994 | (JP) | 29/857 |

* cited by examiner

*Primary Examiner*—Carl J. Arbes
*Assistant Examiner*—Minh Trinh
(74) *Attorney, Agent, or Firm*—Oliff & Berridge, PLC

(57) ABSTRACT

Connectors and electrical wires of a wire harness are temporarily arranged on a plate, and an interior panel on which fixtures are provided is set on the plate on which the wire harness is temporarily arranged. Connectors and electric wires are held by the fixtures, and the interior panel is separated from the plate, so that the wire harness is integrated with the interior panel. Since connectors and electric wires are positively held by the fixtures, the shape of the wire harness is not collapsed, and the fixtures are used not only as temporary fixtures but also as final fixtures to attach the wire harness onto the interior panel. Accordingly, when the automobile manufacturer attaches the interior panel to an automobile body, the wire harness is simultaneously incorporated into the automobile body.

12 Claims, 3 Drawing Sheets

APPARATUS AND METHOD OF MANUFACTURING AN AUTOMOBILE WIRING HARNESS HAVING A PREDETERMINED WIRING ROUTE

BACKGROUND OF THE INVENTION

1. Field of Invention

The present invention relates to the manufacture of a wire harness for automobile use. More particularly, the present invention relates to the manufacture of a wire harness for automobile use integrated with an interior panel of an automobile.

2. Description of Related Art

A wire harness for electrically connecting various electrical parts mounted on an automobile is attached onto interior panels of the automobile such as an instrument panel, door panel, roof panel and back door panel. Conventionally, the wire harness is attached onto the interior panels in the following manner. The wire harness, which has been supplied by a wire harness manufacturer in a single form, is attached onto interior panels by an automobile manufacturer. Then, the interior panels onto which the wire harness has already been attached are mounted on a body of an automobile.

The above work conducted by the automobile manufacturer takes time and requires much labor. Especially, in the automobile factory in which the number of electronic parts to be mounted on an automobile has increased recently, there is a strong demand for simplifying the wire harness attaching process to be conducted by the automobile manufacturer.

A problem to be solved by the present invention is to simplify a process in which the wire harness is attached onto an interior panel of an automobile body by an automobile manufacturer.

SUMMARY OF THE INVENTION

In order to solve the above problem, the invention provides a method of manufacturing a wire harness for automobile use in which a wire harness is formed on a plate and subsequently transferred to an interior panel of an automobile body. Specifically, insulation displacement contact connectors are temporarily fixed to a plate used for temporarily wiring a wire harness. A predetermined number of electric wires are guided from an electric wire feeder to a wiring robot, the arm end of which can be moved three-dimensionally. The electric wires are wired along a predetermined wiring route on the plate by an insulation displacement contact wiring machine arranged at the end of the robot arm of the wiring robot, and the electric wires are pressed into grooves of terminals in the insulation displacement contact connectors. Covers are then attached to the insulation displacement contact connectors.

The wire harness is made along a predetermined wiring route on the plate as described above, and the design of the wiring route is made to be the same as the design of a wiring route on the interior panel. This interior panel is put on the plate in such a manner that the wiring side of the interior panel is arranged on the plate side, and then the wire harness temporarily arranged on the plate is transferred onto the interior panel. Due to the foregoing, a wire harness integrated with the interior panel can be easily obtained. When a wire harness maker supplies the above wire harness integrated with the interior panel to an automobile manufacturer, both the interior panel and the wire harness can be simultaneously mounted on an automobile body by the automobile manufacturer. Therefore, the manufacturing process can be greatly simplified.

In this case, fixtures capable of holding the insulation displacement contact connectors and electric wires for the wire harness are arranged at the insulation displacement contact connector attaching positions and along the wire harness electric wire arranging route on the interior panel. The wire harness on the plate is held by the fixtures when the interior panel is put on the plate, and then the interior panel is separated from the plate. Thus, the wire harness is transferred from the plate onto the interior panel. Due to the foreging, the wire harness can be transferred from the plate onto the interior panel while the profile of the wire harness is not collapsed. At the same time, the wire harness can be strongly attached onto the interior panel by the fixtures. Therefore, even after the interior panel has been mounted on an automobile body, it is unnecessary to fix the wire harness again.

In another aspect, the invention relates to a wire harness integrated with the interior panel on which the fixtures are arranged.

DETAILED DESCRIPTION OF PREFERRED EMBODIMENTS

Figure 1:
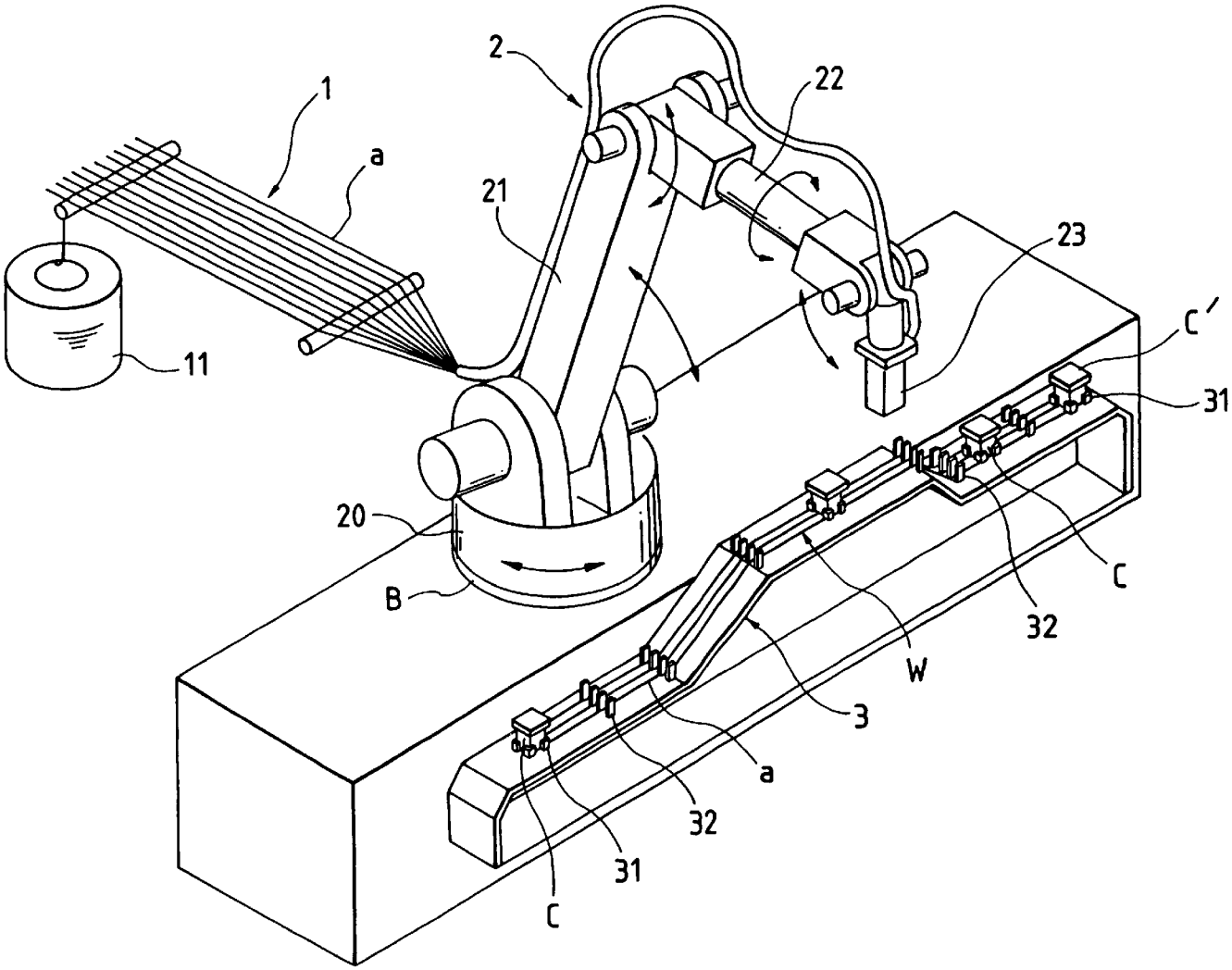
FIG. 1 is a perspective view showing a temporary wiring device and plate of the embodiment FIG. 2(*a*) is a view showing a process in which a wire harness is transferred from the plate to the interior panel, FIG. 2(*b*) is a cross-sectional view taken on line A—A in FIG. 2(*a*), and FIG. 2(*c*) is a cross-sectional view taken on line B—B in FIG. 2(*a*)

FIG. 1 is a view showing an embodiment of apparatus used to manufacture a wire harness for automobile use integrated with an interior panel. In FIG. 1, reference numeral 1 is an electric wire feed section, reference numeral 2 is a pressure welding and wiring robot, and reference numeral 3 is a plate on which wire harness W is temporarily arranged. The associated electric control unit and controller are omitted in the drawing.

The electric wire feed section 1 is provided with a bundle 11 of electric wires, and electric wires "a" are drawn out from the bundle 11 of electric wires by the wiring robot 2. In this case, the number of electric wires "a" to be drawn out is arbitrarily determined.

The wiring robot 2 is composed in such a manner that a first arm 21 is rotatably attached to a rotating table 20 capable of rotating on base B, a second arm 22 is rotatably attached to the first arm 21, and an insulation displacement contact wiring machine 23 to be used as a head is rotatably attached to the second arm. This wiring robot 2 three-dimensionally moves the insulation displacement contact wiring machine 23 in accordance with a previously determined program and arranges electrical wires "a" on the plate 3 along a predetermined route while the electric wires "a" are being drawn out from the electric wire feed section 1. While arranging the electrical wires "a" on the plate 3, the wiring robot 2 conducts insulation displacement contact so that the electric wires "a" can be connected to the insulation displacement contact terminals of connectors C. It is possible to use various types of electric wires such as enameled wires and insulation-covered wires for the electric wires "a".

Figure 2A:
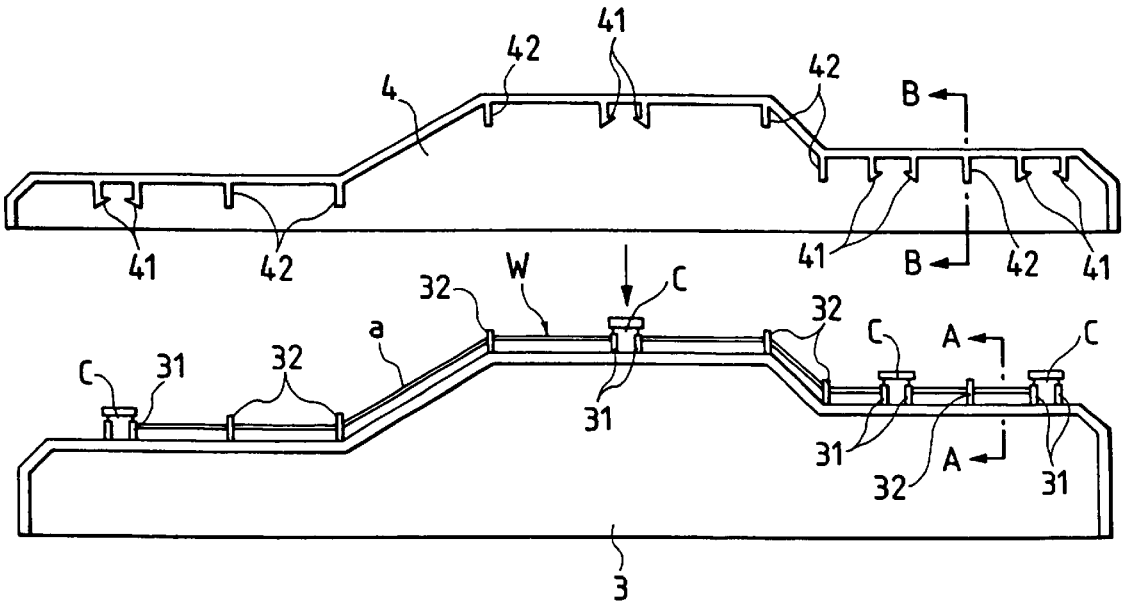
Figure 2B:
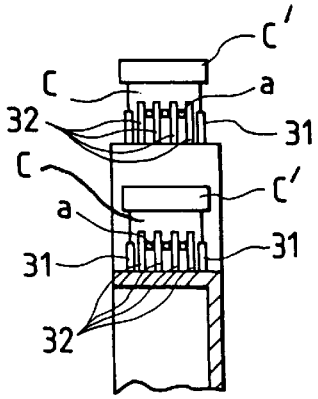
Figure 2C:
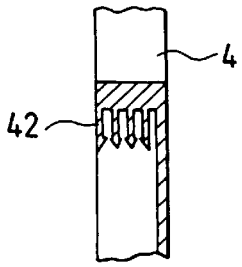

The plate 3 is used for temporarily arranging wire harness W. As shown in FIGS. 1 and 2(*a*), there are provided rod-shaped protrusions 31, 32 used for temporarily setting connectors C and electric wires "a" at predetermined positions on the temporary wiring surface of the plate 3.

In this embodiment, separately from the plate 3 and the device described above, there is prepared an interior panel 4 onto which wire harness W is attached by a wire harness maker according to the conventional method. As described in the discussion of the prior art, examples of this interior panel 4 are an instrument panel, door panel, roof panel and back door panel.

As shown in. FIG. 2(*a*), in order to attach the wire harness onto these interior panels 4, there are provided fixtures 41, 42 capable of holding connectors C and electric wires "a" at predetermined positions on the interior panel 4. As shown in FIGS. 2(*a*) and 2(*c*), these fixtures 41, 42 are composed of a plurality of rod-shaped holding claws, the end portions of which are formed into hooks. Each holding claw is elastic and flexible. A connector C or electric wire "a" is inserted between the holding claws, which are adjacent to each other, and held by both holding claws, so that it can be attached onto the interior panel 4. A side of the end portion of each holding claw onto which the connector C or electric wire "a" is inserted is tapered in a direction so that the insertion of the connector C or electric wire "a" can be facilitated. On the opposite side, there is formed a surface perpendicular to the longitudinal direction of the holding claw so that the connector C or electric wire "a" cannot be pulled out from between the holding claws. Utilizing the interior panel 4, plate 3 and device described above, wire harness W integrated with an interior panel is manufactured as follows.

First, connectors C are temporarily attached to the protrusions 31 on the plate 3, which are used for temporarily attaching connectors C, by manual labor. This work can be automated by a robot.

After connectors C have been temporarily attached to the protrusions 31, as shown in FIG. 1, electric wires "a" are arranged on the plate 3 along a predetermined route. At the same time, the electrical wires "a" are displaced into to the terminals of connectors C, and covers C' are put on the connectors C.

Figure 3:
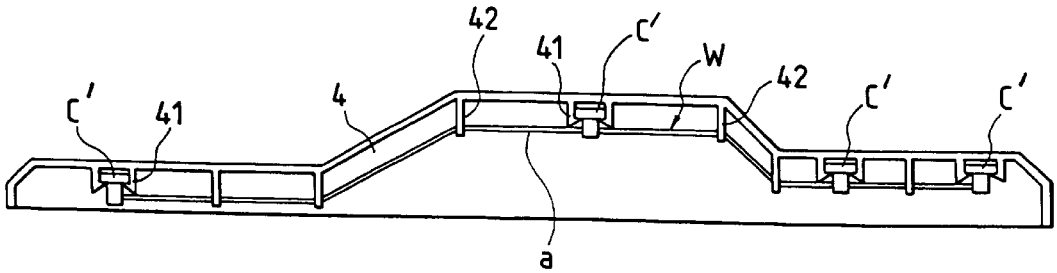
FIG. 3 is a view showing a completed wire harness of the embodiment integrated with an interior panel.

When all connectors C have been connected to electric wires "a", the covers C' have been set on the connectors C, and these electric wires "a" have been arranged on the plate 3, the manufacture of wire harness W is completed on the plate 3. Then, as shown in FIG. 2(*a*), the interior panel 4 on which the fixtures 41, 42 are provided is set on the plate 3 on which wire harness W has been temporarily attached. While connectors C and electric wires "a" are being held by the fixtures 41, 42, the interior panel 4 is separated from the plate 3. In this way, wire harness W is transferred from the plate 3 onto the interior panel 4 as shown in FIG. 3, and wire harness W integrated with the interior panel 4 can be obtained.

Since connectors C and electric wires "a" are held by the fixtures 41, 42 in the process of separating the interior panel 4 from the plate 3, the shape of wire harness W is not collapsed, and these fixture 41, 42 are used not only as temporary fixtures but also as final fixtures to attach wire harness W onto the interior panel 4. Accordingly, when the automobile manufacturer attaches this interior panel 4 to an automobile body, attaching of wire harness W is simultaneously completed. Therefore, efficiency of the assembling work can be greatly enhanced.

As explained above, according to the present invention, a wire harness manufacturer makes a wire harness integrated with an interior panel by a simple manufacturing process, and when the wire harness is supplied to an automobile manufacturer in this state, when the automobile manufacturer attaches the interior panel to an automobile body, the wire harness is simultaneously attached. In this way, efficiency of the assembling work can be greatly enhanced.

The invention has been described with reference to its preferred embodiments, which are intended to be illustrative and not limiting. Variations and modifications may be made without departing from the spirit and scope of the invention as defined in the appended claims.

What is claimed is:

1. A method of manufacturing a wire harness integrated with a panel, comprising:

wiring at least one wire along a predetermined wiring route on a plate having at least one connector to form the wire harness;

putting the panel onto the plate in such a manner that a wiring surface of the panel, including a wiring route corresponding to the predetermined wiring route of the plate, is set on the plate; and transferring the wire harness onto the panel.

2. The method according to claim 1, wherein transferring the wire harness onto the panel comprises:

arranging at least one fixture that holds the at least one connector and the at least one electric wire of the wire harness on the panel;

holding the wire harness arranged on the plate, by the at least one fixture when the panel is set on the plate; and separating the panel from the plate.

3. The method according to claim 1, wherein wiring the at least one wire on the plate comprises:

temporarily fixing the at least one connector to the plate;

wiring the at least one wire along the predetermined wiring route on the plate into a final wire harness shape;

attaching the at least one wire to the at least one connector; and attaching at least one cover to the at least one connector.

4. The method according to claim 1, wherein the plate has a three dimensional configuration.

5. The method according to claim 3, wherein at least one robot carries out at least one of the temporary fixing of the at least one connector, the wiring of the at least one wire, the attaching of the at least one wire to the at least one connector, and the attaching of the at least one cover to the at least one connector.

6. The method according to claim 3, wherein the at least one connector is an insulation displacement contact connector.

7. The method according to claim 4, wherein at least a portion of the panel includes a three dimensional configuration corresponding to the three dimensional configuration of the plate.

8. The method of claim 5, wherein the at least one robot comprises a three-dimensionally movable arm end, and wherein the robot carries out the wiring and attaching of the at least one wire via an attaching and wiring machine arranged at the three-dimensionally movable arm end.

9. The method according to claim 6, wherein attaching the at least one wire comprises displacing the at least one wire into the insulation displacement contact connector.

10. A panel having an integrated wire harness comprising:

at least one electric wire along a predetermined wiring route;

a plate onto which the wiring route is formed, the plate having at least one connector to form the wire harness, wherein the panel is placed on the plate in such a manner that a wiring surface of the panel includes a wiring route corresponding to the predetermined wiring route of the plate, wherein the wiring harness is transferred onto the panel in such a manner that at least one fixture capable of holding the at least one connector and the at least one wire harness on the panel; and a means for holding the connector and the electric wire, the means being arranged at an attaching position of the at least one connector and in the predetermined route of the wire.

11. The panel according to claim 10, wherein said holding means comprises at least one rod-shaped holding claw having a hook formed at a distal end thereof.

12. The panel according to claim 11, wherein said hook comprises a first face that is substantially perpendicular to a longitudinal direction of the claw and a second face that is tapered with respect to the longitudinal direction of the claw.

* * * * *